US009296119B2

(12) United States Patent
Klockow et al.

(10) Patent No.: US 9,296,119 B2
(45) Date of Patent: Mar. 29, 2016

(54) CROSS-CUT DEVICE FOR DICING MACHINE

(71) Applicant: Urschel Laboratories, Inc., Valparaiso, IN (US)

(72) Inventors: Scott Alan Klockow, Kouts, IN (US); Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 190 days.

(21) Appl. No.: 14/058,503

(22) Filed: Oct. 21, 2013

(65) Prior Publication Data

US 2014/0109737 A1 Apr. 24, 2014

Related U.S. Application Data

(60) Provisional application No. 61/716,100, filed on Oct. 19, 2012.

(51) Int. Cl.

| | |
|---|---|
| ***B26D 7/06*** | (2006.01) |
| ***B26D 7/18*** | (2006.01) |
| ***B26D 1/38*** | (2006.01) |
| *B26D 3/18* | (2006.01) |

(52) U.S. Cl.

CPC ..... *B26D 7/1845* (2013.01); *B26D 1/38* (2013.01); *B26D 7/0691* (2013.01); *B26D 3/18* (2013.01); *Y10T 83/04* (2015.04); *Y10T 83/9377* (2015.04)

(58) Field of Classification Search

CPC .. B26D 7/1845; B26D 7/0691; B26D 7/2614; Y10T 83/6472; Y10T 83/6473

USPC ..... 83/402, 403, 404.3, 407, 408

See application file for complete search history.

(56) References Cited

U.S. PATENT DOCUMENTS

| | | | | |
|---|---|---|---|---|
| 3,857,310 | A * | 12/1974 | Tiby | 83/26 |
| 4,625,606 | A * | 12/1986 | Pinegar et al. | 83/403 |
| 4,743,307 | A * | 5/1988 | Mason | 127/2 |
| 4,906,145 | A | 3/1990 | Oliver | |
| 6,895,846 | B2 * | 5/2005 | Walker et al. | 83/403 |
| 2002/0144584 | A1 * | 10/2002 | Arrasmith et al. | 83/663 |
| 2010/0263510 | A1 * | 10/2010 | Klockow et al. | 83/162 |

FOREIGN PATENT DOCUMENTS

| | | |
|---|---|---|
| JP | 2008-178962 | 8/2008 |
| KR | 10-2004-0083560 | 10/2004 |

* cited by examiner

*Primary Examiner* — Ned Landrum
*Assistant Examiner* — Richard Crosby, Jr.
(74) *Attorney, Agent, or Firm* — Hartman Global IP Law; Gary M. Hartman; Michael D. Winter

(57) ABSTRACT

An apparatus for cutting food product includes at least one knife having longitudinal ends and a hollow spindle. The knife has a central region therebetween and a base and opposite sides located along a longitudinal extent thereof. The hollow spindle has a slot for receiving the knife. The slot has a base wall for engaging and supporting the base of the knife and side walls for engaging and supporting the sides of the knife. The spindle includes a circumferential wall in which at least two circumferential gaps are present to segment the wall into at least two end wall segments and a third wall segment therebetween. The gaps separate the slot into at least two end slot segments and a third slot segment therebetween that are complementary to and receive, respectively, the base and side walls of the knife at the longitudinal ends and central region, respectively, of the knife.

11 Claims, 12 Drawing Sheets

SECTION D-D

SECTION C-C

SECTION C-C

SECTION F-F

SECTION F-F

SECTION G-G

SECTION G-G

CROSS-CUT DEVICE FOR DICING MACHINE

CROSS REFERENCE TO RELATED APPLICATIONS

This application claims the benefit of U.S. Provisional Application No. 61/716,100, filed Oct. 19, 2012, the contents of which are incorporated herein by reference.

BACKGROUND OF THE INVENTION

The present invention generally relates to methods and equipment for cutting solid and semisolid materials, including food products.

The Affinity® dicer is a machine manufactured by Urschel Laboratories and is particularly well suited for dicing various materials, a notable but nonlimiting example being cheese. The Affinity® dicer is well known as capable of high capacity output and precision cuts. In addition, the Affinity® dicer has a sanitary design to deter bacterial growth.

A representation of an Affinity® dicer is shown in FIG. 1. Product is delivered to a feed hopper (not shown) and enters a rotating impeller 10, where centrifugal force holds the product against the inside of a stationary case 12 equipped with a slicing knife 14. Paddles 11 of the impeller carry the product past the slicing knife 14, producing slices that pass between a rotating feed drum 16 and feed roll 18, then enter circular cutter 20 equipped with circular knives where the slices are cut into strips. The strips pass directly into a cross-cutter 22 equipped with crosscut knives that produce the final cut to yield a diced product.

FIGS. 2 and 3 schematically represent longitudinal and diametrical cross-sections of the cross-cutter 22 showing a hollow spindle 24 adapted to be coaxially mounted on a shaft (not shown). The spindle 24 defines a continuous circumferential wall 26 in which slots 28 are formed for receiving knives 30 of the cross-cutter 22. As evident from FIG. 3, the slots 28 have a rectangular cross-section to define a base wall 32 and side walls 34 that support each knife 30 along its entire length at its base and opposite sides, respectively. The base and sides of the knives 30 define square edges, and the slots 28 are complementarily formed so that the base wall 32 and side walls 34 of each slot 28 also define square interior corners. While the cross-cutter 22 and the Affinity® dicer as a whole is manufactured to high sanitation standards for continuous operation, the square interior corners of the slots 28 can pose a challenge to thorough cleaning of the cross-cutter 22.

In view of the above, it can be appreciated that improvements for material cutting equipment is continuously sought, and that it would be desirable if a cutting device, for example, the cross-cutter of the Affinity® dicer, were available that promotes the ability of the device to be cleaned.

BRIEF DESCRIPTION OF THE INVENTION

The present invention provides apparatuses for cutting food product, for example, the cross-cutter of the Urschel Affinity® dicer, that promotes the ability of the device to be cleaned. Aspects and advantages of the invention will be better appreciated from the following detailed description.

According to a first aspect of the invention, an apparatus for cutting food product includes at least one knife having longitudinal ends and a hollow spindle. The knife has a central region between its longitudinal ends, and a base and opposite sides located along a longitudinal extent thereof. The hollow spindle has a slot for receiving the knife. The slot has a base wall for engaging and supporting the base of the knife and side walls for engaging and supporting the sides of the knife. The spindle includes a circumferential wall in which at least two circumferential gaps are present to segment the wall into at least two end wall segments and a third wall segment therebetween. The gaps separate the slot into at least two end slot segments and a third slot segment therebetween that are complementary to and receive, respectively, the base and side walls of the knife at the longitudinal ends and central region, respectively, of the knife.

According to a second aspect of the invention, an apparatus for cutting food product includes at least one knife having longitudinal ends and a hollow spindle. The knife has a central region between its longitudinal ends, and a base and opposite sides located along a longitudinal extent thereof. The hollow spindle has a slot for receiving the knife. The slot has a base wall for engaging and supporting the base of the knife and side walls for engaging and supporting the sides of the knife. The base and opposite sides of the knife are not supported along the entire length of the knife.

A technical effect of the invention is the ability to throughly clean the slots of the spindle. In particular, it is believed that, by providing gaps along the length of the slot, a majority of the square interior corners of the slot is eliminated thereby facilitating the ability of the spindle to be cleaned.

Other aspects and advantages of this invention will be better appreciated from the following detailed description.

DETAILED DESCRIPTION OF THE INVENTION

Figure 1:
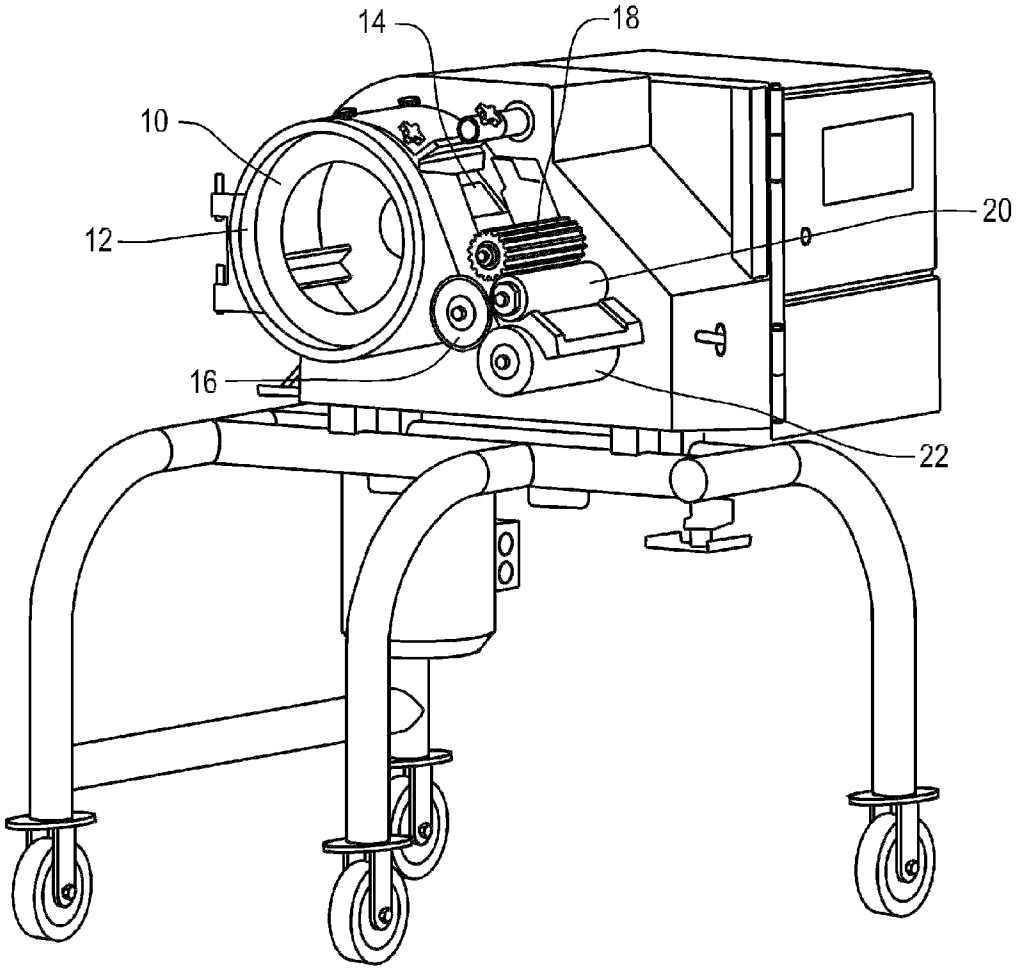
FIG. 1 (Prior Art)
FIG. 1 schematically represents an example of an Affinity® dicer machine.
Figure 4:
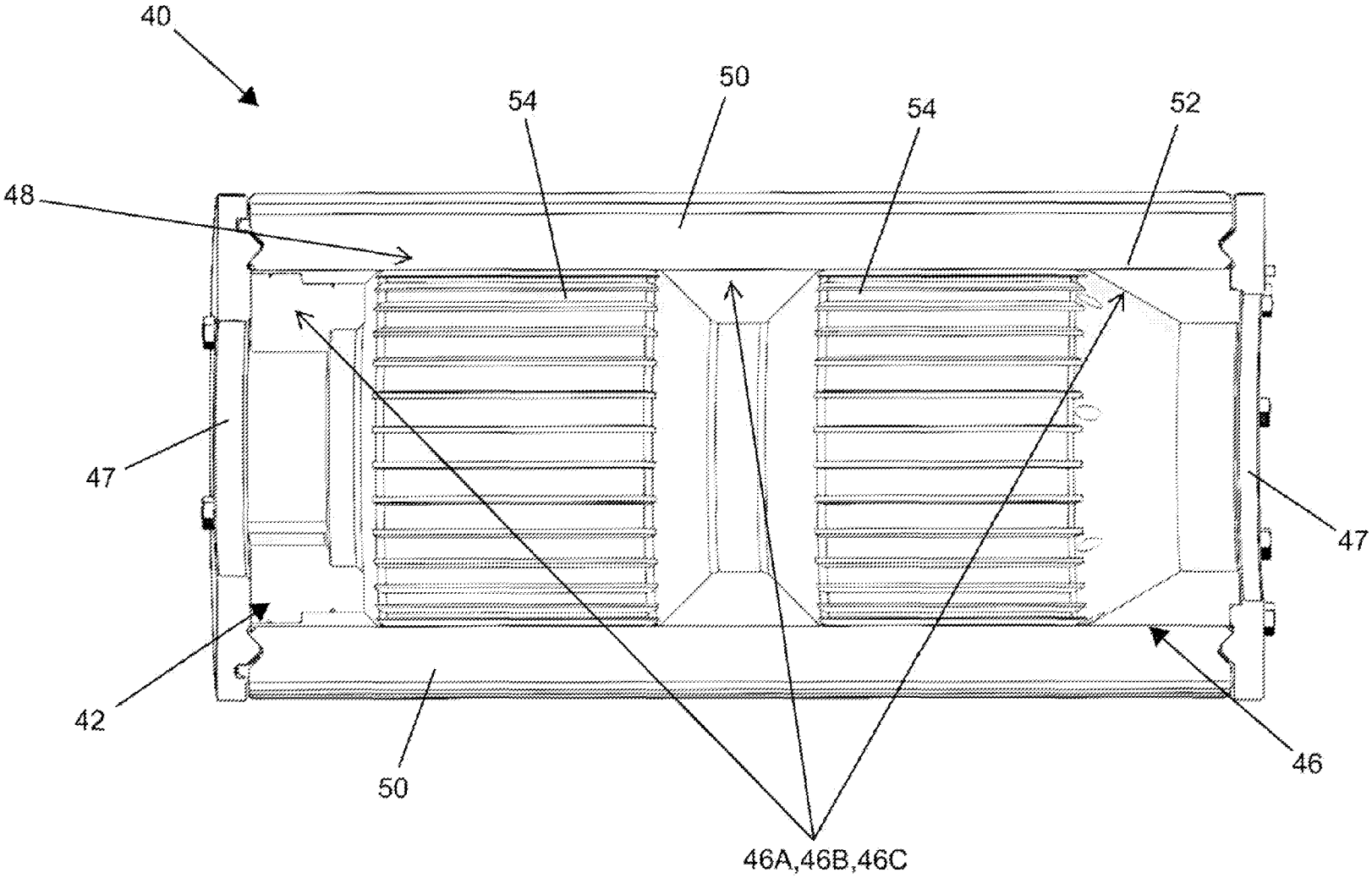
FIG. 4 represents an isolated longitudinal cross-sectional view of a modified cross-cutter suitable for use in the Affinity® dicer machine of FIG. 1 in accordance with as aspect of the invention.
Figure 5:
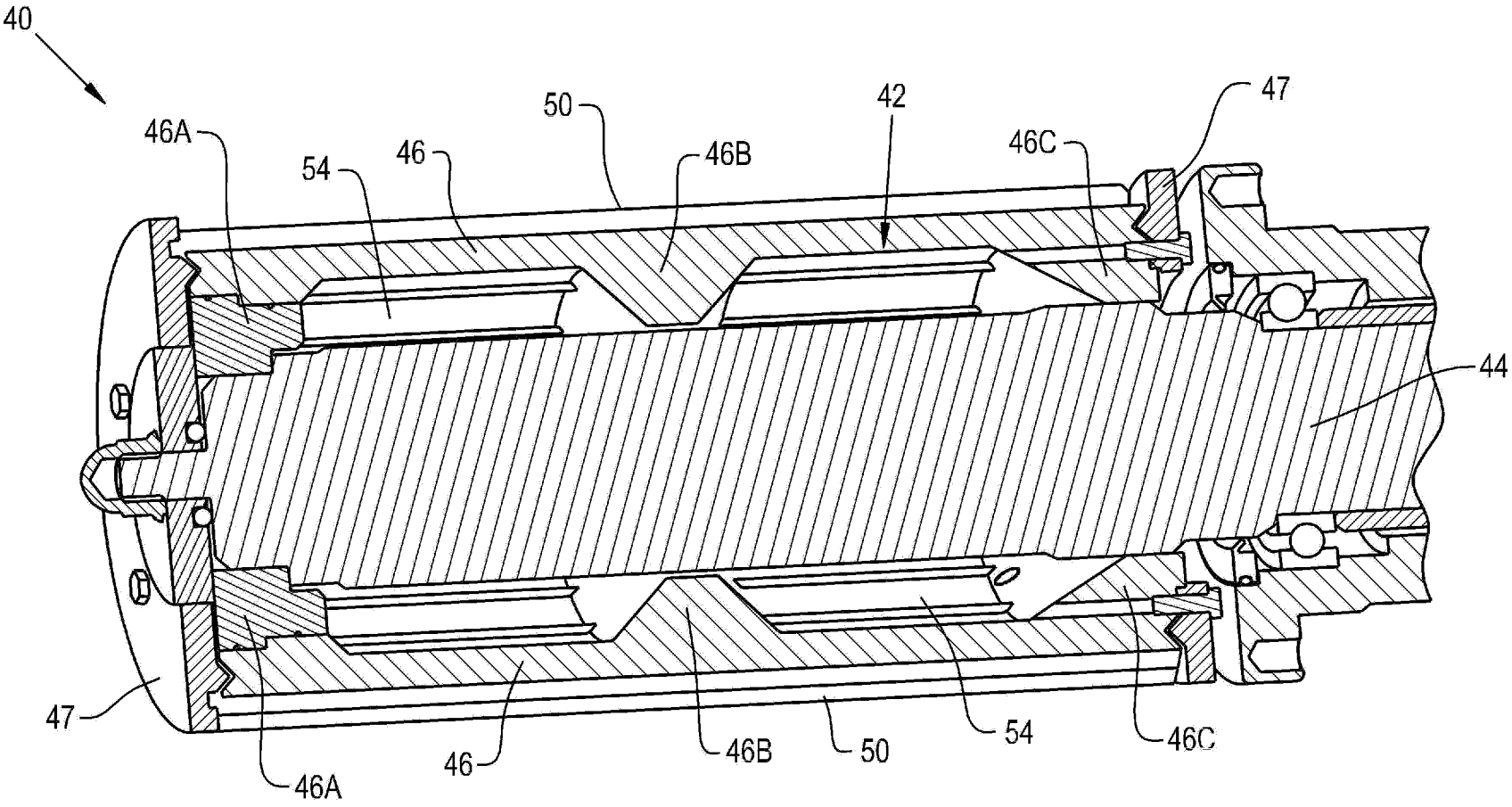
FIG. 5 is a fragmentary perspective view showing a typical installation of the modified cross-cutter of FIG. 4, and showing the cross-cutter and adjacent components in longitudinal cross-section.
Figure 6:
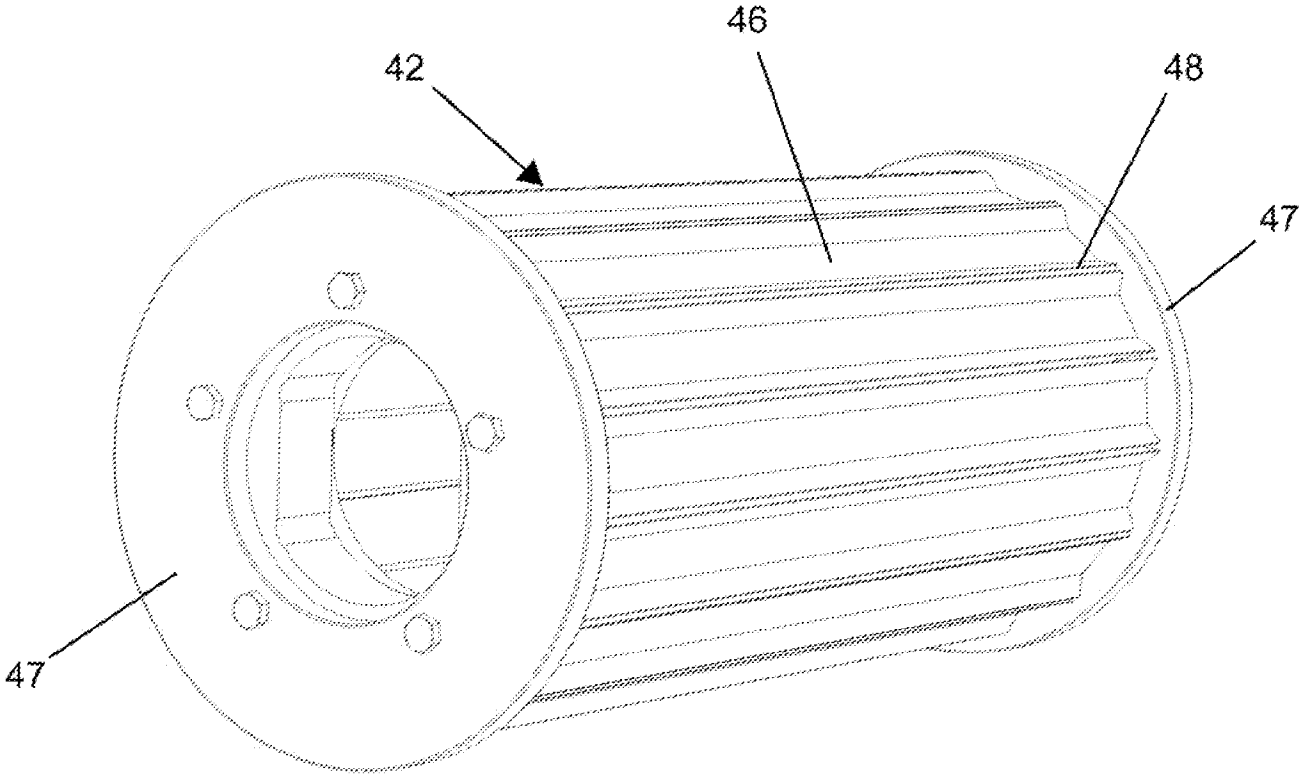
FIG. 6 is an isolated perspective view of the spindle of FIGS. 4 and 5.
Figure 7:
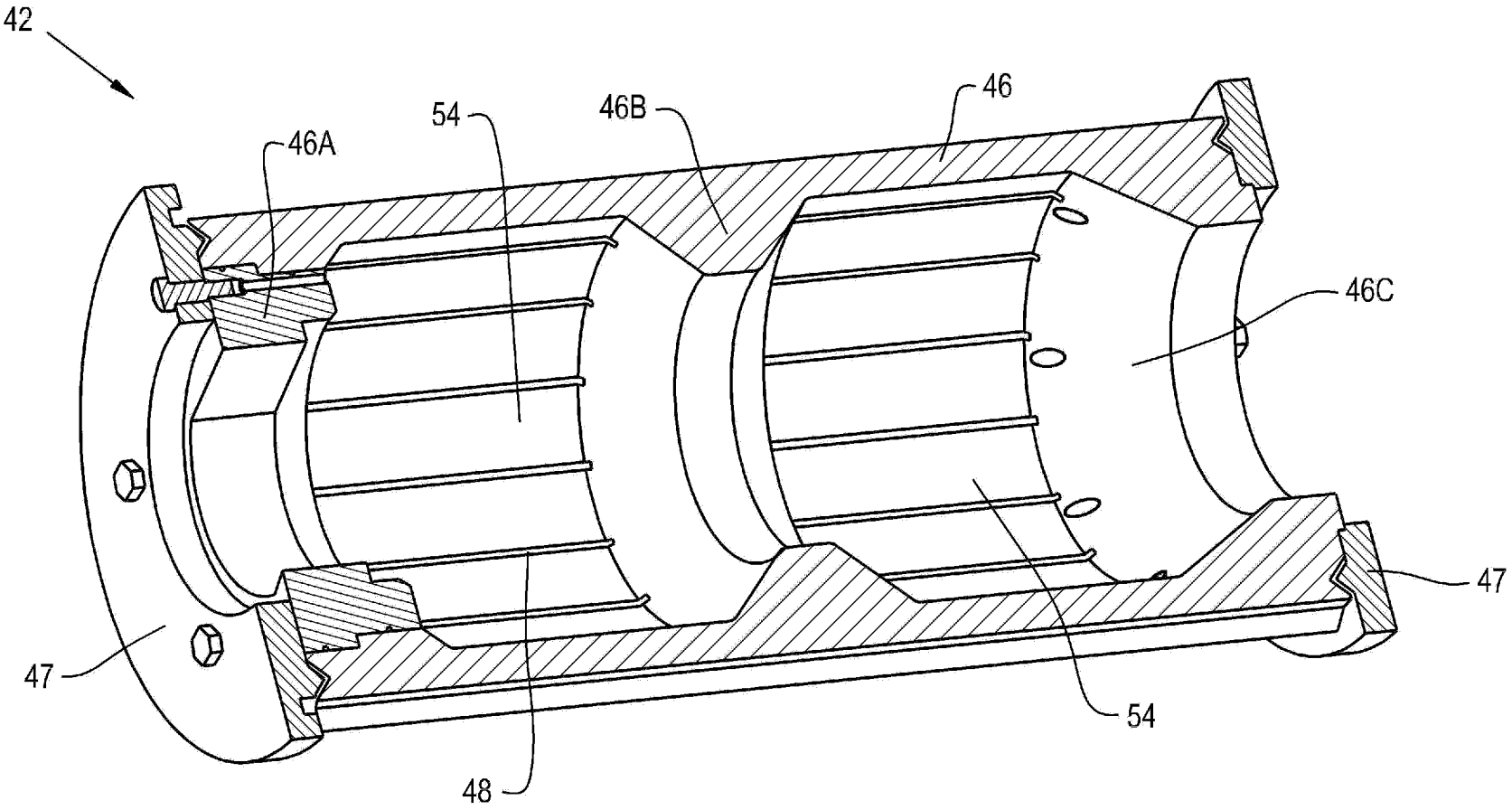
FIG. 7 is a cross-sectional perspective view of the spindle of FIG. 6.
Figure 8:
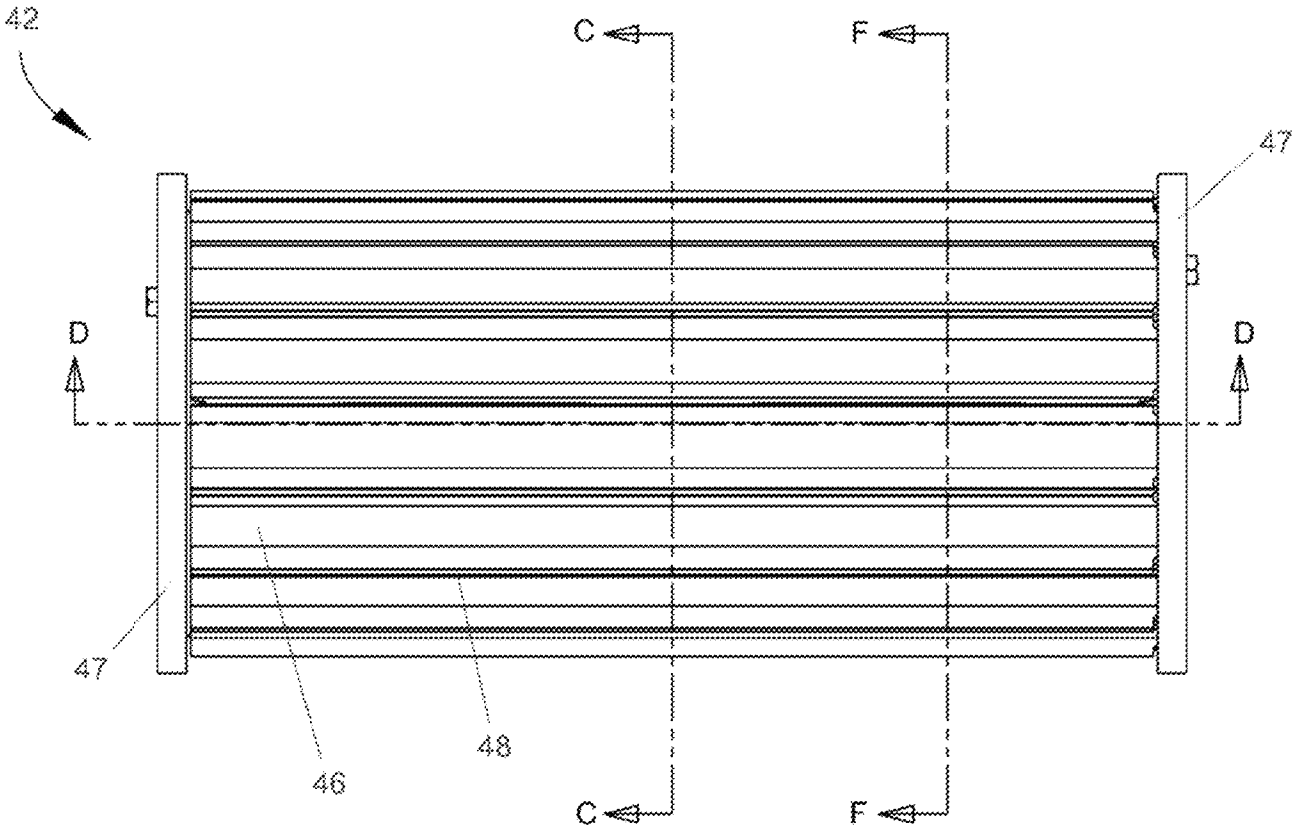
FIG. 8 is an isolated longitudinal view of the spindle of FIG. 6.
Figure 9:
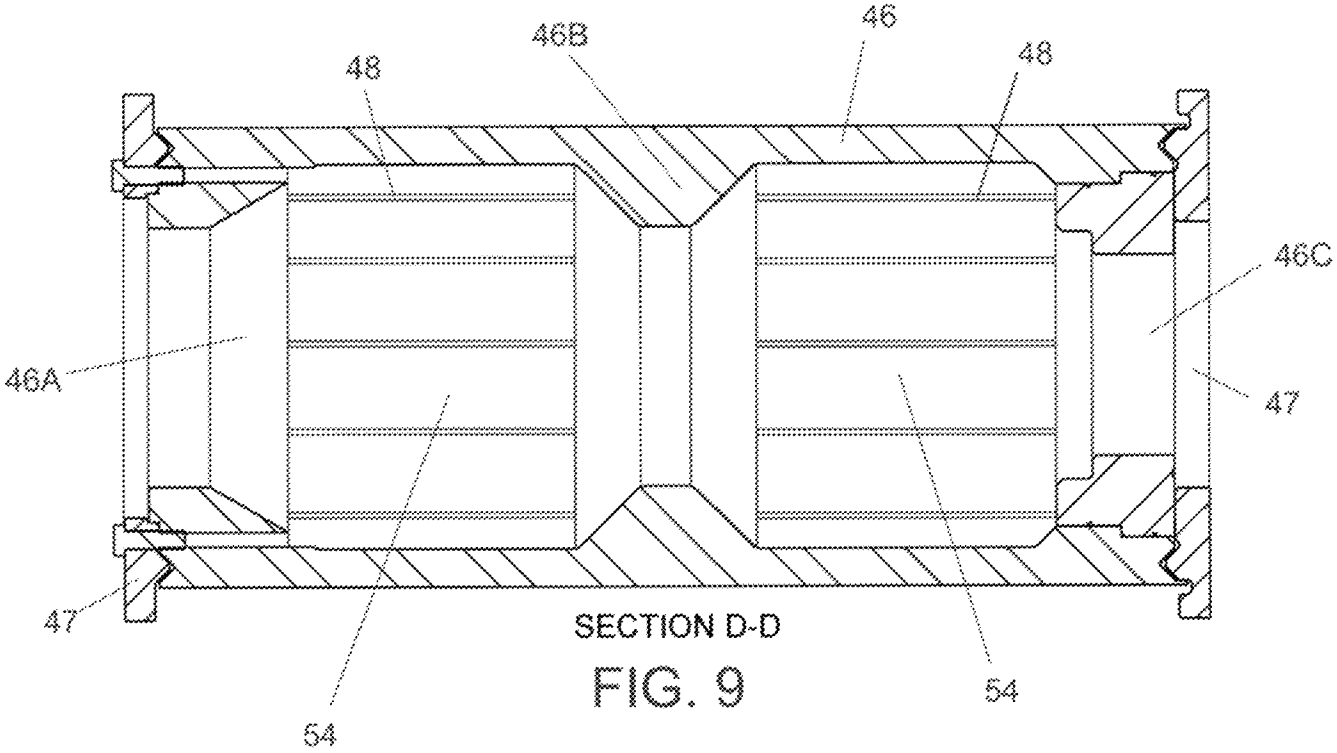
FIG. 9 is a cross-sectional view of the spindle of FIG. 8 taken along section line D-D.

FIGS. 4 and 5 depict a modified cross-cutter 40 suitable for use with the Affinity® dicer represented in FIG. 1. The cross-cutter 40 is adapted to produce cross-cuts in a sliced product to achieve a dicing effect and a diced product, though those skilled in the art will appreciate that the cross-cutter 40 and its benefits are not limited to such uses, nor limited to the Affinity® dicer.

As represented in FIG. 4, the cross-cutter 40 comprises a hollow spindle 42 adapted to be coaxially mounted on a shaft 44, as shown in FIG. 5. Various isolated views of the spindle 42 are represented in FIGS. 6-15. As with the prior art spindle 24 of FIGS. 2 and 3, the spindle 42 defines a circumferential wall 46 between end plates 47 in which slots 48 are formed for receiving knives 50 of the cross-cutter 40. However, from FIGS. 4, 5, 7, 9, 14 and 15, it can be seen that the wall 46 is discontinuous to define three annular wall segments 46A, 46B and 46C, with one of the wall segments 46B being central and between the other two segments 46A and 46C, which are generally located at opposite axial extents of the spindle 42. As such, the spindle 42 represented in FIGS. 4, 5, 7, 9, 14 and 15, defines two gaps 54 disposed between the central wall segment 46B and the two end segments 46A and 46C. Optionally, one or more of the segments 46A, 46B, and 46C, as well as the end plates 47, may be releasably secured to the wall 46, as represented by segment 46A in FIG. 7.

Figure 2:
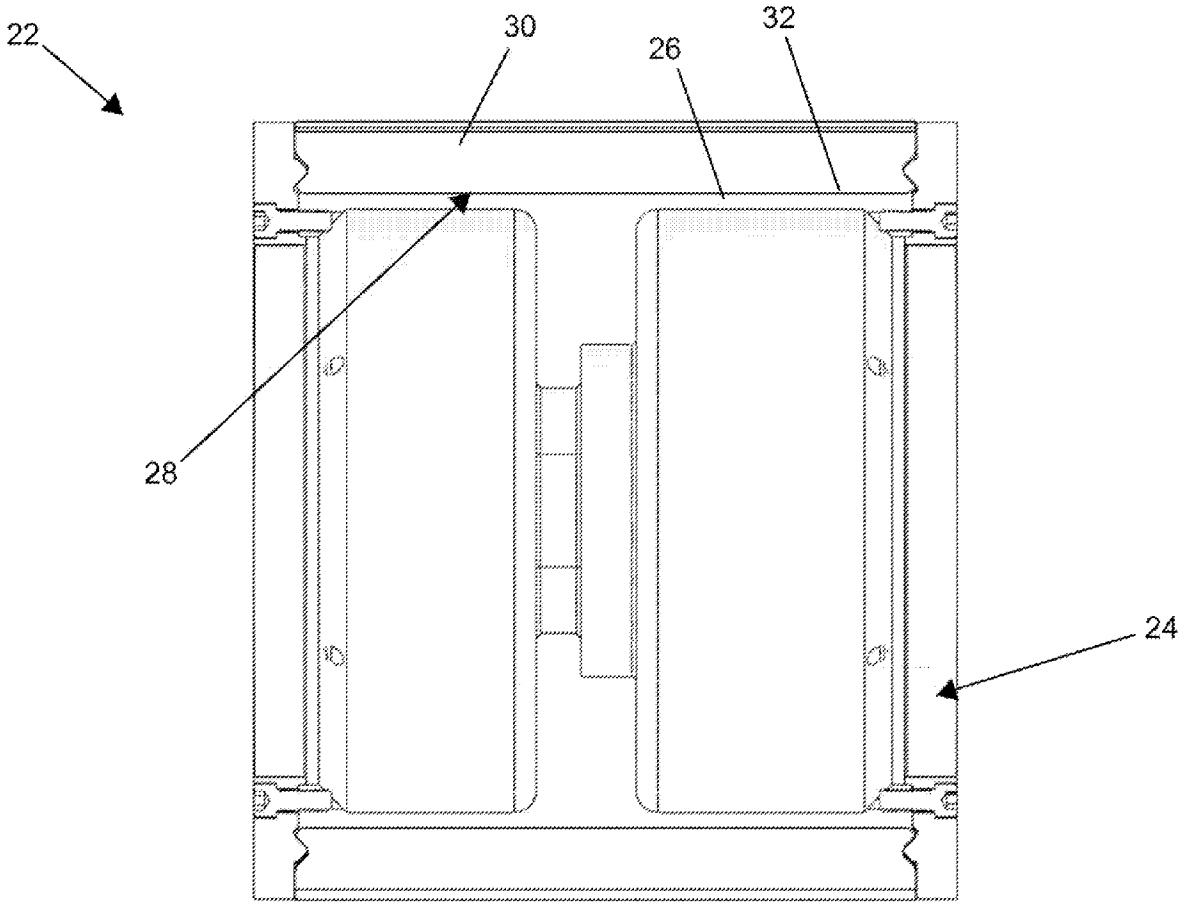
FIG. 2 (Prior Art)
FIGS. 2 and 3 represent fragmentary longitudinal and diametrical cross-sectional views, respectively, of a cross-cutter of the Affinity® dicer machine of FIG. 1.
Figure 3:
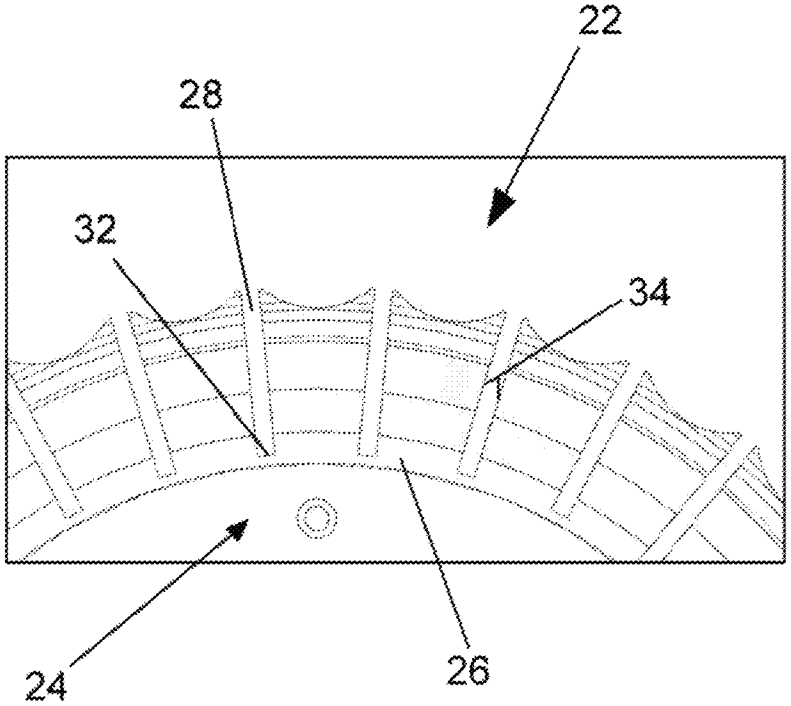
FIG. 3 (Prior Art)
Figure 11:
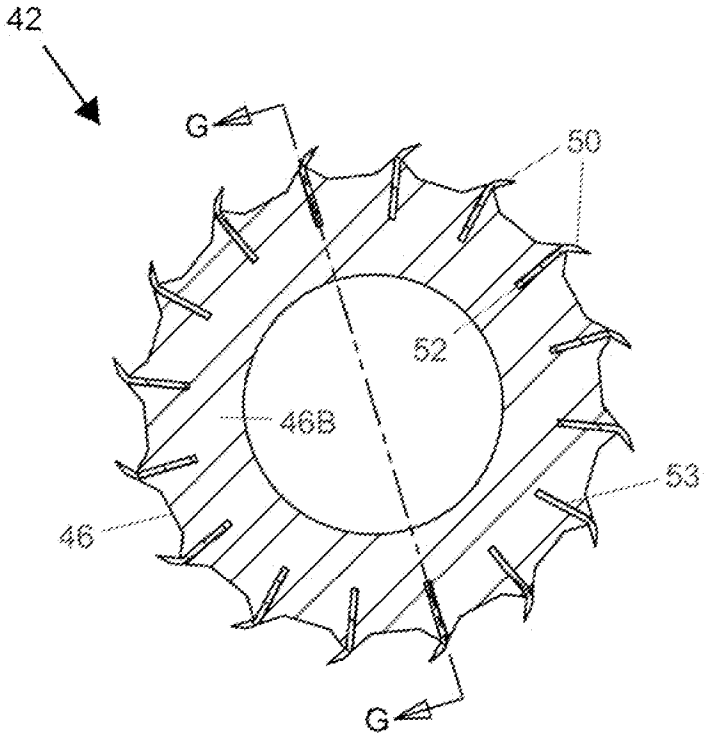
FIGS. 10 and 11 are cross-sectional views of the spindle of FIG. 8 taken along section line C-C, without knives installed and with knives installed, respectively.
Figure 10:
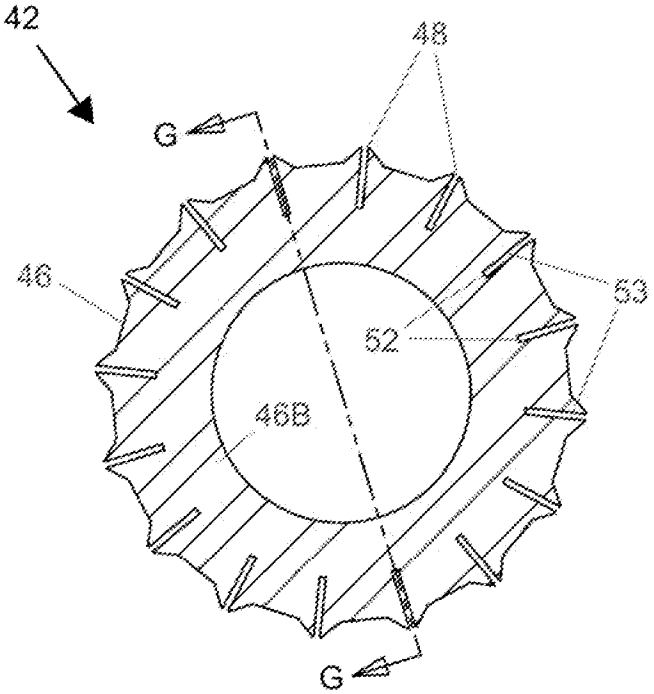
Figure 13:
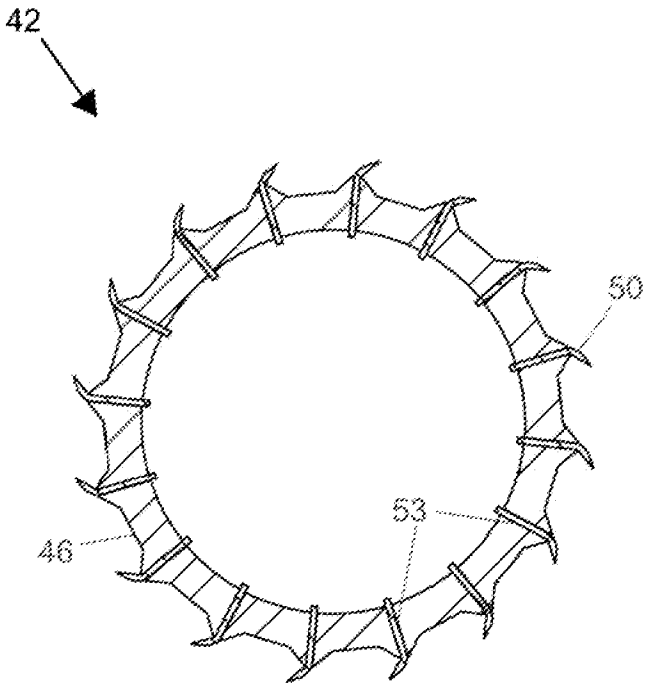
FIGS. 12 and 13 are cross-sectional views of the spindle of FIG. 8 taken along section line F-F, without knives installed and with knives installed, respectively.
Figure 12:
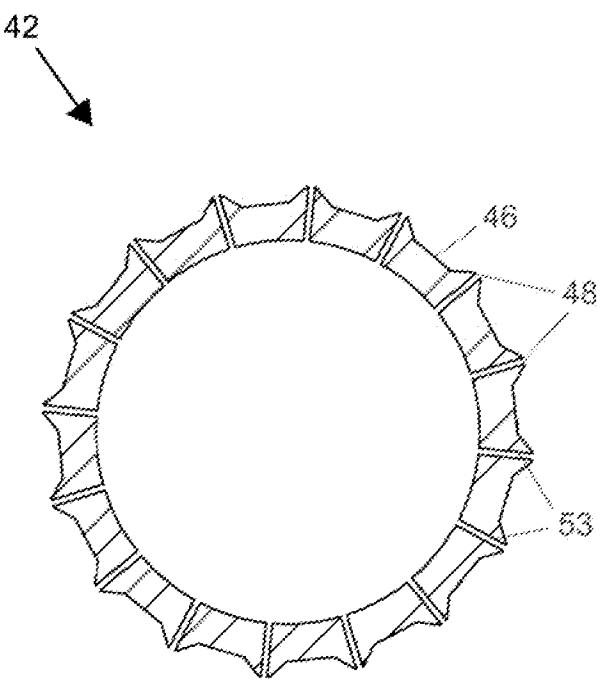
Figure 14:
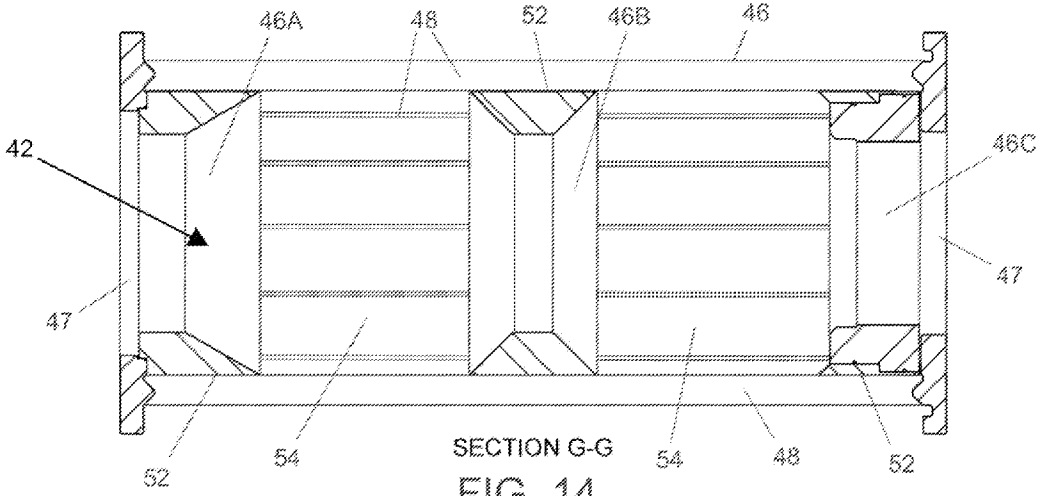
FIGS. 14 and 15 are cross-sectional views of the spindle of FIGS. 10 and 11 taken along section line G-G, without knives installed and with knives installed, respectively.
Figure 15:
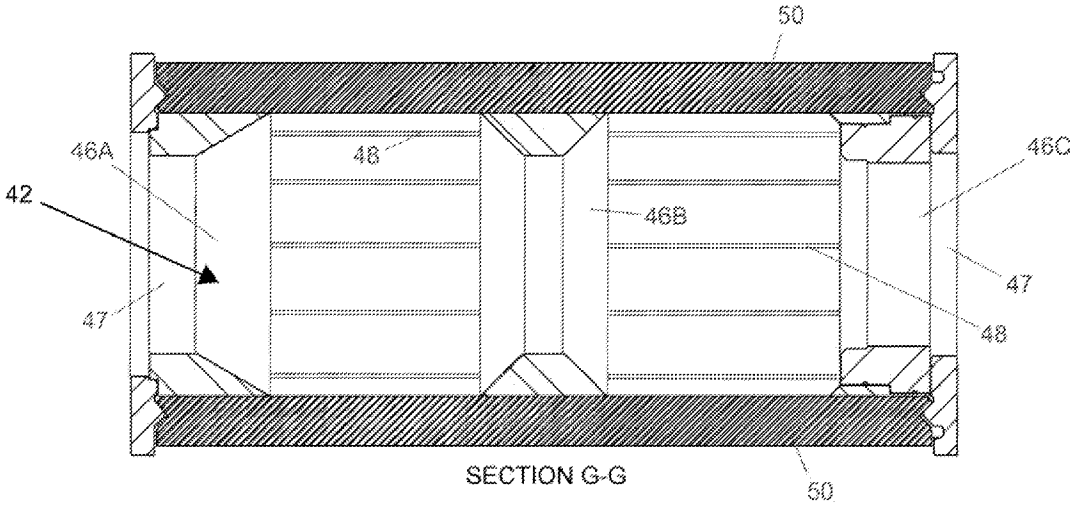

Also similar to the prior art spindle 24 of FIGS. 2 and 3, the slots 48 defined in the spindle 42 may have a rectangular cross-section to define a base wall 52 and intersecting side walls 53 that support the knives 50, as represented in FIGS. 11, 13, and 15. As a result, the slots 48 are formed so that the base wall 52 and side walls 53 of each slot 48 define square interior corners that are complementary to square edges defined by the base and sides of each knife 50. However, the slots 48 are segmented as a result of the segmented wall 46 of the spindle 42, such that the base and opposite sides of each knife 50 are not supported along the entire length of the knife 50. Instead, a central region and the ends of each knife 50 are supported by separate portions of the slot 48 located in the central wall segment 46B and the two end segments 46A and 46C, respectively, defining unsupported portions exposed to the gaps 54. As such, each knife 50 locates to the spindle 42 at the ends and center of the spindle 42 to maintain an accurate knife placement and provide adequate rigidity. In addition, the base wall 52 of the slot 48 may be located at a position closer to an axis of rotation of the spindle 42 than interior regions of the circumferential wall 46 defined by the gaps 54. As represented in FIGS. 5 and 13, this arrangement may allow the base of each knife 50 to protrude from the interior regions of the wall 46 in a direction towards the axis of rotation of the spindle 46.

Advantageously, the gaps 54 defined by the spindle 42 between the portions of the slots 48 facilitate the ability to thoroughly clean the slots 48, such that even greater sanitation can be achieved. As evident from FIGS. 4, 5, 7, 9, 14, and 15, the gaps 54 between the wall segments 46A, 46B and 46C define the majority of the length of each slot 48, eliminating a majority of the square interior corners of each prior art slot 28 in FIGS. 2 and 3 that are more difficult to clean. The spindle 42 may be cleaned after operating the apparatus to cut a food product by directing a fluid into the slots 48 in order to have at least some of the fluid pass through the slots 48 into the gaps 54.

While the invention has been described in terms of a specific embodiment, it is apparent that other forms could be adopted by one skilled in the art. For example, the physical configuration of the spindle 42, slots 48 and knives 50 could differ from that shown, and various materials and processes could be used to manufacture the apparatus 50 and its components. Therefore, the scope of the invention is to be limited only by the following claims.

The invention claimed is:

1. An apparatus for cutting food product, the apparatus comprising:

at least a first knife having longitudinal ends, a central region therebetween, and a base and opposite sides located along a longitudinal extent thereof; and a hollow spindle having a slot for receiving the first knife, the slot having a base wall for engaging and supporting portions of the base of the first knife and side walls for engaging and supporting portions of the opposite sides of the first knife, the spindle comprising a circumferential wall in which at least two circumferential gaps are present to segment the base wall of the slot into at least three segments including two end wall segments and a third wall segment therebetween, the two end wall segments and the third wall segment therebetween and the side walls of the slot adjacent thereto are complementary to and receive, respectively, the base and opposite sides of the first knife at the longitudinal ends and central region, respectively, of the first knife.

2. The apparatus of claim 1, wherein areas of the base and opposite sides of the first knife are not in direct contact with the base wall of the slot along the longitudinal extent of the first knife, defining unsupported portions of the first knife exposed to the at least two circumferential gaps in the circumferential wall of the spindle.

3. The apparatus of claim 1, wherein areas of the base of the first knife protrude from an interior of the circumferential wall and extend in a direction towards an axis of rotation of the spindle over portions of the spindle defined by portions of the slot between the two end and third wall segments.

4. The apparatus of claim 1, wherein portions of the slot between the two end and third wall segments define a majority of a length of the slot.

5. The apparatus of claim 1, wherein at least one of the two end wall segments is releasably secured to the circumferential wall of the spindle.

6. An apparatus for cutting food product, the apparatus comprising:

at least a first knife having longitudinal ends, a central region therebetween, and a base and opposite sides located along a longitudinal extent thereof; and a hollow spindle having a slot for receiving the first knife, the slot having a base wall for engaging and supporting portions of the base of the first knife and side walls for engaging and supporting portions of the opposite sides of the first knife, wherein the first knife comprises at least first, second, and third portions each comprising a separate area of the base and opposite sides of the first knife adjacent thereto, the third portion being located between the first and second portions along the longitudinal extent of the first knife, the first and second portions being in direct contact with and supported by the base wall and side walls of the slot of the spindle, wherein the third portion of the first knife is not in direct contact with the base wall of the slot of the spindle due to at least one gap in the base wall of the slot.

7. The apparatus of claim 6, wherein the spindle comprises a circumferential wall and the base of the first knife within the third portion of the knife protrudes from an interior of the circumferential wall and extends in a direction towards an axis of rotation of the spindle over portions of the spindle.

8. The apparatus of claim 6, wherein portions along the longitudinal extent of the first knife that are not in direct contact with the base wall of the slot of the spindle define a majority of the longitudinal extent of the first knife.

9. The apparatus of claim 1, wherein the side walls of the slot are in contact with the portions of the opposite sides of the first knife along an entirety of the longitudinal extent thereof.

10. The apparatus of claim 6, wherein the side walls of the slot are in contact with the portions of the opposite sides of the first knife along an entirety of the longitudinal extent thereof.

11. A method of using the apparatus of claim 6, the method comprising:

operating the apparatus to cut food product; and then cleaning at least the spindle of the apparatus with a fluid by directing the fluid into the slot, wherein at least some of the fluid passes through the slot into the at least one gap of the base wall of the slot.

* * * * *